US009254022B2

(12) United States Patent
Meldeau et al.

(10) Patent No.: US 9,254,022 B2
(45) Date of Patent: Feb. 9, 2016

(54) SELF-SUPPORTING BAG WITH INSULATED COMPARTMENT

(75) Inventors: William Brent Meldeau, Chatsworth, CA (US); Tina M. Tillman, Stuart, FL (US)

(73) Assignee: Earthly Goods International, LLC, Jensen Beach, FL (US)

( * ) Notice: Subject to any disclaimer, the term of this patent is extended or adjusted under 35 U.S.C. 154(b) by 269 days.

(21) Appl. No.: 13/401,976

(22) Filed: Feb. 22, 2012

(65) Prior Publication Data

US 2013/0216158 A1 Aug. 22, 2013

(51) Int. Cl.

| | |
|---|---|
| ***B65D 33/14*** | (2006.01) |
| ***B65D 30/04*** | (2006.01) |
| ***B65D 30/22*** | (2006.01) |
| ***B65D 30/16*** | (2006.01) |
| ***B65D 81/38*** | (2006.01) |
| ***B65D 30/00*** | (2006.01) |
| ***A45C 1/02*** | (2006.01) |
| ***A45C 3/06*** | (2006.01) |
| ***A45C 7/00*** | (2006.01) |
| ***A45C 11/20*** | (2006.01) |
| ***A45C 3/04*** | (2006.01) |
| *A45C 3/00* | (2006.01) |

(52) U.S. Cl.

CPC ..... *A45C 7/0077* (2013.01); *A45C 3/04* (2013.01); *A45C 11/20* (2013.01); *A45C 2003/002* (2013.01)

(58) Field of Classification Search

CPC ... A45C 3/04; A45C 2003/002; A45C 7/0077

USPC ..... 383/24, 117, 40, 38, 104, 110, 15, 37; 150/112, 127

See application file for complete search history.

(56) References Cited

U.S. PATENT DOCUMENTS

| | | | | | |
|---|---|---|---|---|---|
| 1,251,404 | A | * | 12/1917 | Mills | 150/100 |
| RE25,826 | E | | 8/1965 | Ward | |
| 4,503,559 | A | * | 3/1985 | Warnke | 383/40 |
| 4,984,662 | A | | 1/1991 | Jacober | |
| 5,005,679 | A | | 4/1991 | Hjelle | |
| 5,209,279 | A | * | 5/1993 | Wilson | 150/111 |
| 5,288,150 | A | * | 2/1994 | Bearman | 383/38 |
| 5,354,131 | A | * | 10/1994 | Mogil | 383/24 |
| 5,413,199 | A | * | 5/1995 | Clement | 190/108 |
| 5,526,907 | A | * | 6/1996 | Trawick et al. | 190/111 |
| 5,570,824 | A | * | 11/1996 | Lyon et al. | 224/240 |
| 5,603,573 | A | * | 2/1997 | Mercier et al. | 383/117 |
| 5,660,476 | A | | 8/1997 | DeCoster | |

(Continued)

*Primary Examiner* — Jes F Pascua
*Assistant Examiner* — Derek Battisti
(74) *Attorney, Agent, or Firm* — Matthew J. Lattig; Charter IP, LLC

(57) ABSTRACT

A self-supporting bag configured to carry attire, equipment, food, beverage, and the like includes a first pair of upstanding mesh side panels joined together at respective side edges to form a shaped compartment body defining an inner body cavity having an opening at an upper end thereof, and an insulated compartment affixed to lower edges of the joined first pair of mesh side panels, a top outer surface of the thermal compartment forming a bottom panel of the bag. The compartment includes a re-closeable opening accessible from the exterior of the bag. The bag further includes a second plurality of mesh panels attached between the compartment and outer surfaces of the first pair of upstanding mesh side panels as a plurality of end pockets and side pockets around the periphery of the bag, the end pockets rendering the bag self supporting in the absence of rigid framing.

11 Claims, 8 Drawing Sheets

(56) References Cited

U.S. PATENT DOCUMENTS

| | | | | |
|---|---|---|---|---|
| 6,015,072 | A * | 1/2000 | Young | 224/153 |
| 6,105,844 | A | 8/2000 | Walters et al. | |
| 6,363,739 | B1 | 4/2002 | Hodosh et al. | |
| 6,409,066 | B1 | 6/2002 | Schneider et al. | |
| 6,439,389 | B1 * | 8/2002 | Mogil | 206/579 |
| 6,481,239 | B2 | 11/2002 | Hodosh et al. | |
| 6,513,661 | B1 | 2/2003 | Mogil | |
| 6,595,687 | B2 * | 7/2003 | Godshaw et al. | 383/6 |
| 6,644,063 | B2 | 11/2003 | Mogil | |
| 6,665,913 | B2 * | 12/2003 | Kosh et al. | 24/193 |
| 7,004,317 | B2 * | 2/2006 | Severa et al. | 206/315.1 |
| 7,341,377 | B1 * | 3/2008 | Baxter | 383/38 |
| 7,624,777 | B2 * | 12/2009 | Paller | 150/112 |
| 8,043,004 | B2 | 10/2011 | Mogil | |
| 2002/0012480 | A1 * | 1/2002 | Konno | 383/111 |
| 2002/0015538 | A1 * | 2/2002 | Snider | 383/18 |
| 2003/0024960 | A1 | 2/2003 | Greenstein et al. | |
| 2004/0007604 | A1 * | 1/2004 | Plzak | 224/101 |
| 2005/0207682 | A1 * | 9/2005 | Stager | 383/104 |
| 2005/0238261 | A1 * | 10/2005 | Godshaw et al. | 383/40 |
| 2007/0274613 | A1 * | 11/2007 | Pruchnicki et al. | 383/110 |
| 2008/0173685 | A1 * | 7/2008 | Welker et al. | 224/576 |
| 2008/0260303 | A1 * | 10/2008 | De Lesseux et al. | 383/110 |
| 2009/0077842 | A1 * | 3/2009 | Plank et al. | 40/124.06 |
| 2009/0184143 | A1 | 7/2009 | Witt et al. | |
| 2010/0078280 | A1 * | 4/2010 | Mauro | 190/18 A |
| 2010/0133131 | A1 * | 6/2010 | Williams et al. | 206/372 |
| 2010/0284631 | A1 * | 11/2010 | Lee | 383/12 |
| 2011/0270696 | A1 * | 11/2011 | Vincent et al. | 705/23 |
| 2013/0247606 | A1 * | 9/2013 | Suchecki | 62/457.2 |

* cited by examiner

SELF-SUPPORTING BAG WITH INSULATED COMPARTMENT

BACKGROUND

1. Field.

The example embodiment in general relates to a self-supporting bag, more particularly to a self-supporting mesh bag configured to carry articles therein and including an insulated compartment forming a bottom of the bag for insulating hot or cold food and beverage items therein.

2. Related Art

Reusable shopping bags, particularly for groceries and the like, have become increasingly popular both as a matter of convenience, providing greater strength and handling capability, and, as a conservation means reducing the necessity for use of the conventional disposable paper and plastic shopping bags. Known reusable shopping bags are normally constructed from a synthetic plastic, woven or recyclable material, have an upwardly opening and include opposed loop handles for convenient carrying.

Tote bags are extensively used by consumers, travelers and athletes. The design, construction and versatility of tote bags, couples with its generally, flexible, light-weight design and construction, allows users to partially or completely fill the tote bag with attire, equipment and other sundry articles. Tote bags typically have a handle or straps for hand or shoulder carrying.

Soft sided insulated containers have become popular for carrying either articles that may best be served cool, such as beverages or salads, or warm, such as appetizers, hot dogs, and the like. Such containers are frequently used to carry liquids, whether hot liquids, such as soup containers, coffee or tea, or cold liquids such as beer, soft drinks, or other carbonated beverages, juices and milk. Sometimes these containers may be used to carry lunches, which may include a sandwich, fruit, carrot and celery sticks, a drink, cookies, and so on.

Several attempts have been made to combine the functionality of a shopping or tote bag with the functionality provided by a soft-sided insulated container. Conventional designs include a non-collapsible, hard-sided tote-bag with separate cooling compartment, a non-collapsible bag system with separate hard-sided shopping bag atop a cooling compartment, and various multi-enclosure soft-sided collapsible bags in which one or more of the compartments is insulated for hot or cold food/beverage items. None of the conventional designs foresee a completely self-supporting, collapsible bag with an upward opening as in the conventional reusable shopping bag, but with an integral bottom configured as an insulated compartment.

SUMMARY

An example embodiment is directed to a self-supporting bag. The bag includes a first pair of upstanding mesh side panels joined together at respective side edges to form a shaped compartment body defining an inner body cavity having an opening at an upper end thereof, and an insulated compartment affixed to lower edges of the joined first pair of mesh side panels, a top outer surface of the insulated compartment forming a bottom panel of the bag. The compartment includes a re-closeable opening accessible from the exterior of the bag. The bag further includes a second plurality of mesh panels attached between the compartment and outer surfaces of the first pair of upstanding mesh side panels as a plurality of end pockets and side pockets around the periphery of the bag, the end pockets rendering the bag self supporting in the absence of rigid framing.

Another example embodiment is directed to a self-supporting bag having a pair of upstanding side panels joined together at respective side edges to form a shaped compartment body defining an inner body cavity having an opening at an upper end thereof, an insulated compartment affixed to lower edges of the joined pair of mesh side panels so as to form a bottom panel of the bag, and a plurality of end pockets arranged on the periphery of the bag to render the bag self-supporting in the absence of rigid framing. The bag further includes a pair of opposed webbing loops defining carrying straps centrally located at opposed upper edges of each upstanding side panel at the opening of the bag, and a pair of cam buckles, each affixed on separate facing strap parts of the opposed loops where the strap part meets a respective side panel upper edge.

Another example embodiment is directed to a self-supporting bag having a pair of upstanding side panels joined together at respective side edges to form a shaped compartment body defining an inner body cavity having an opening at an upper end thereof, an insulated compartment affixed to lower edges of the joined pair of mesh side panels so as to form a bottom panel of the bag, a pair of opposed webbing loops defining carrying straps centrally located at opposed upper edges of each upstanding side panel at the opening of the bag, and a handle enclosing one of the opposed webbing loops and selectively enclosing the other of the opposed webbing loops.

BRIEF DESCRIPTION OF THE DRAWINGS

The example embodiment will become more fully understood from the detailed description given herein below and the accompanying drawings, wherein like elements are represented by like reference numerals, which are given by way of illustration only and thus are not limitative of the example embodiment herein.

DETAILED DESCRIPTION

As to be described in detail hereafter, the example embodiment is directed to a self-supporting bag configured to carry attire, equipment, food, beverages, and the like. In general, the self-supporting bag serves multiple purposes and includes a hot or cold (insulated) storage compartment affixed to a bottom thereof. The main shaped compartment body is made of mesh fabric allowing for breathability. External mesh side pockets provide additional storage and encompass the bag to add rigidity, so that the bag can stand straight in the absence of rigid framing. The bag may be suspended by adjustable webbing loops defining carrying straps that include cam buckles on the strap parts of the loops to convert between hand-hold and shoulder-wear configurations. The self-supporting bag collapses and rolls into a drawstring mesh bag "pack-style" as a tote for ease of storage and transport.

Figure 1:
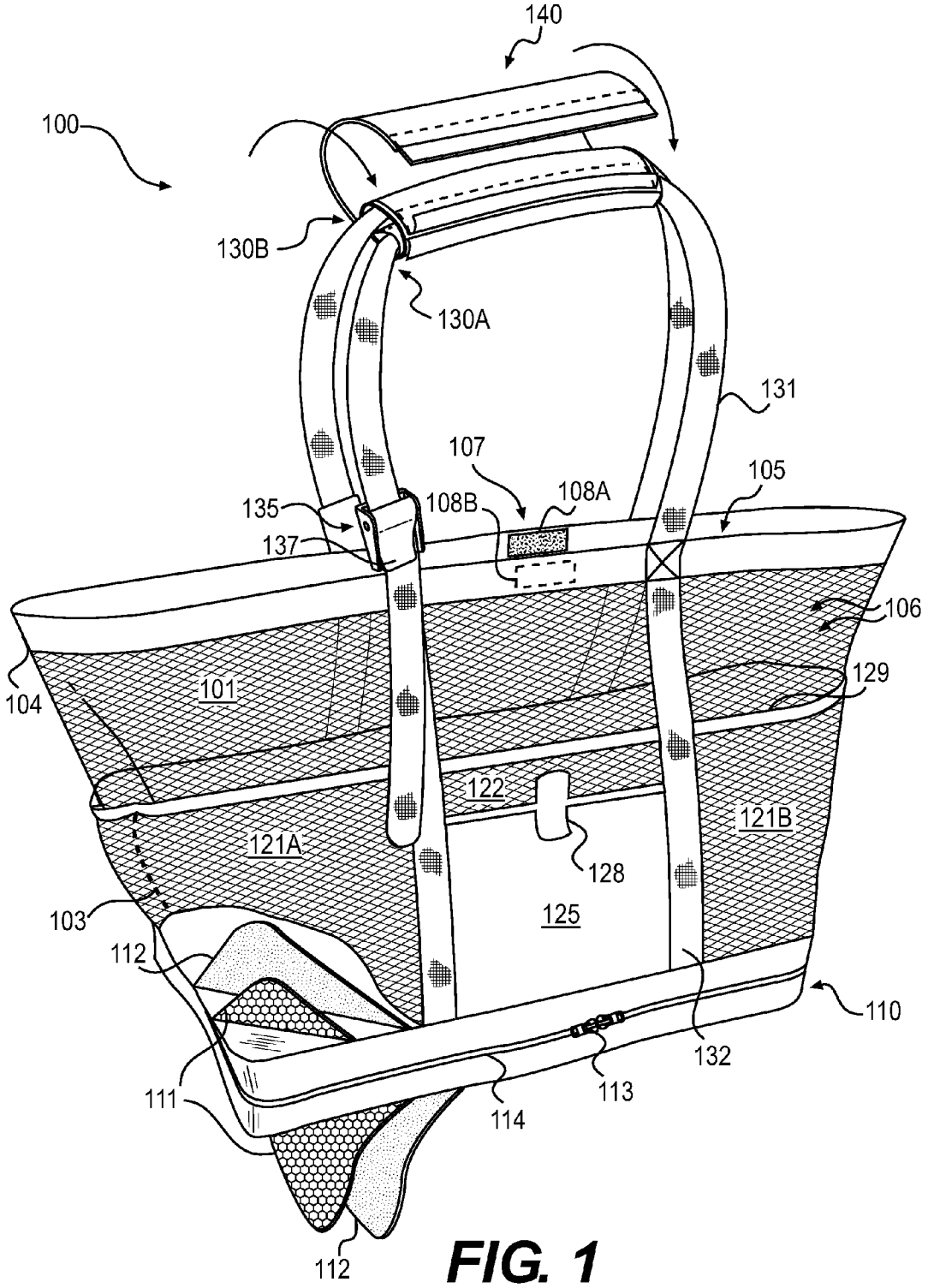
FIG. 1 is a perspective front view of a self-supporting bag in accordance with the example embodiment.
Figure 2:
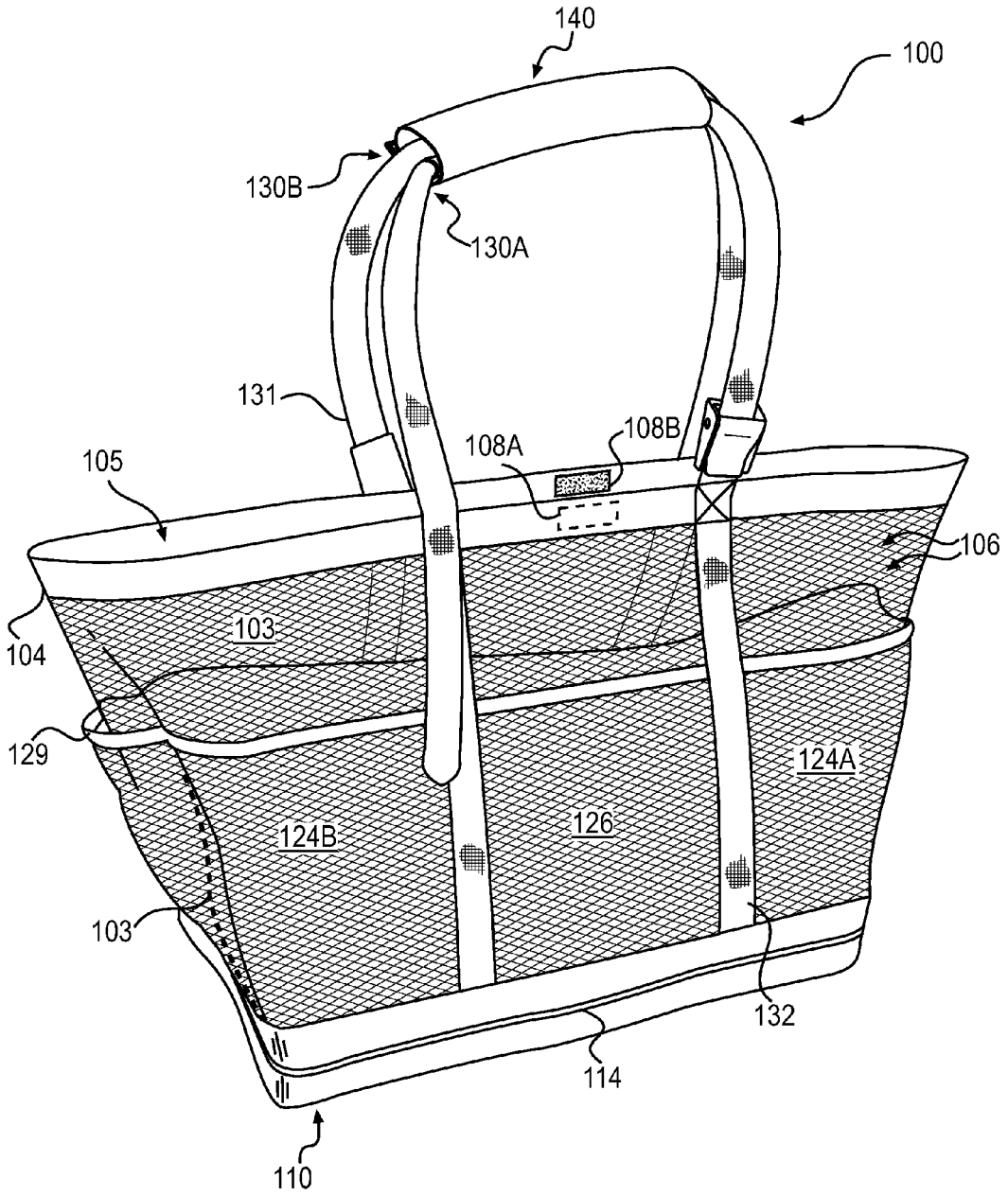
FIG. 2 is a rear perspective view of the bag in FIG. 1.
Figure 3:
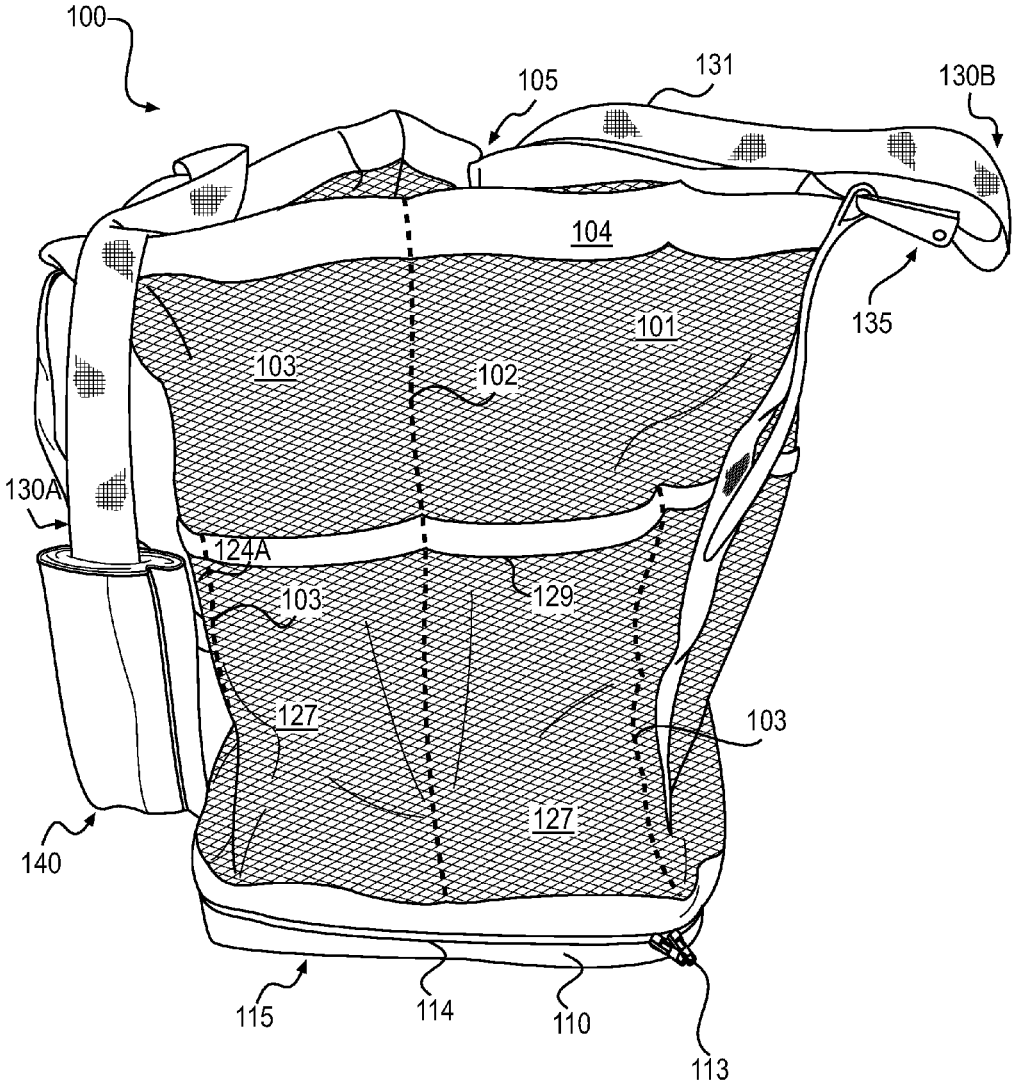
FIG. 3 is a left-side view of the bag in FIG. 1.

FIG. 1 is a perspective front view of a self-supporting bag in accordance with the example embodiment, FIG. 2 a rear perspective view of the bag in FIG. 1, and FIG. 3 a left-side view of the bag in FIG. 1. Referring to FIGS. 1-3, the self-supporting bag (hereafter bag 100) includes a pair of upstanding side panels 101 and 103 forming a front and rear surface of the formed bag 100. The side panels 101, 103 are constructed of a breathable, mesh nylon material that may include perforations/air holes (shown generally by element 106) formed therein. The side panels 101, 103 are joined at respective side edges by a seam 102 (via suitable joining means such as stitching, sealing, adhesive, etc.) to form a shaped compartment body defining an inner body cavity having an opening 105 at an upper end thereof. A singular fold over edge trim 104 encircles the top edges of the side panels 101, 103 as it folds over the upper edges thereof.

Closure means 107 may be affixed to inner surfaces of each side panel upper edge, such as on the inside of edge trim 104, to removably connect the upstanding side panels together at a single point of contact. As showing in FIG. 1, a pair of opposed closer elements 108A, 108B may be employed. In an example, these closers may be embodied by fixed-width Velcro strips, hook and loop elements, snaps, etc., which are centrally located on each side panel upper inner surface, as shown in the examples of FIGS. 1 and 2. This configuration permits at least partial closure of the opening 105 while still allowing user immediate access therein on either side of the closure means 107.

An insulated compartment 110 is affixed (via suitable joining means such as stitching, sealing, adhesive, etc.) to the lower edges of the joined pair of mesh side panels 101, 103. The top outer surface of the insulated compartment 110 may form the bottom panel of the inner body cavity within the bag 100. Compartment 110 is configured as a thermal insulated hot and cold storage container. The compartment 110 may be formed a material comprising one or more combination layers of a polyethylene terephthalate (PET) aluminum film. PET is a typical material of a recycled water bottle. PET aluminum bubble film consists of layers of polyethylene bubbles (a single bubble layer of about 3-4 mm thickness; double bubble layer of about 6.8-8 mm thickness) laminated between layers (single/double) of PET aluminum (PET Al).

As best shown in FIG. 1, compartment 100 includes a pair of (single or double) bubble layers 111 sandwiched between outer PET Al layers 112. PET Al single bubble and PET Al double bubble constructions represent a primary source for auto sun shade, seat cushions, ice bags, cooler bags, and the like. The polyethylene encapsulated air bubbles serve as an effective thermal break as well as a vapor barrier, while the two outer PET aluminum layers reflect up to 97% of all of the radiant heating energy.

The insulated compartment 110 includes a re-closeable opening 114 accessible from the exterior of the bag 100. As shown, this opening 114 is accessible from the bag 100 exterior around the entire circumference or periphery of the insulated compartment 110, and remains closed with a locking element which in an example may be embodied by locking sliders 113 or a zipper clasp. The locking sliders 113 prevent inadvertent opening such that items contained within compartment 110 cannot spill out through the re-closable opening 114.

The self-supporting bag 100 further includes a second plurality of mesh panels embodied as exterior pockets. As shown in FIGS. 1-3, these mesh panels are also constructed of the same breathable, mesh nylon material as that of the upstanding side panels. The exterior mesh panels are arranged between the insulated compartment 110 and outer surfaces of the upstanding mesh side panels 101 and 103 so as to define respective front side pockets 121A and 121B, a center upper side pocket 122, rear side pockets 124A and 124B, a rear center pocket 126 and a plurality of end pockets 127. A singular fold over edge trim 129 represents the top edge of each of the pockets as it folds over the upper edges of the exterior mesh panels on bag 100. Additionally, a centrally located re-closable side pocket 125 for personal effects items is formed between strap part extensions 132 on the front side of bag 100. Re-closable side pocket 125 includes closure means 128 (such as Velcro or other hook and loop fastening means), and is made out of an opaque material such as nylon to obscure valuable items that may be stored therein (e.g., wallet, keys, ID, etc.).

The self supporting bag 100 includes a pair of mesh end pockets 127 on either end thereof, formed between seams 102 and 103 (only one side shown). Each of the exterior pockets permits additional items to be stored, once the carrying capacity within the inner body cavity of bag 100 is full.

The mesh end pockets 127 formed between seams 102 and 103 at either end of the bag 100 provide a secondary function by providing rigidity to the bag 100 in the absence of actual rigid, physical framing. In other words, the end pockets 127 enable the bag 100 to be self-supporting (i.e., stand up straight without user assistance) so that the user can better manage their goods by either placing goods into, or removing the goods out from bag 100.

The bag 100 includes a pair of opposed webbing loops 130A and 130B. The loops define carrying straps for the user and are centrally attached via strap parts 131 to the bag 100 at opposed upper edges of each upstanding side panel 101 and 103 about the opening. A flexible handle 140 completely encloses webbing loop 130As and selectively encloses webbing loop 130B. Handle 140 may be made of a padded foam material in one example.

A strap part 131 of each webbing loop 130A, 130B includes a cam buckle 135 thereon. The straps 131 are in facing relation and the cam buckles 135 are affixed thereon where its strap part 131 meets a respective side panel 101, 103 upper edge (at the edge trim 104, as seen in FIG. 1). Each cam buckle 135 includes a flip latch 137. In operation, the user can manipulate the latch 137 (flip open) to provide quick release of excess strap part 131 of its corresponding webbing loop 130A/B for adjustment between hand-held and shoulder-wear configurations for the bag 100.

Accordingly, the cam buckle 135 permits the user to adjust the strap parts 131 and webbing loops 130A/B with ease. In an example, the user can simply flip open or clamp down the latches 137 on the cam buckles 135 in unison when sliding the webbing shoulder strap to their desired shoulder strap position, or can flip open both latches together and pull down on excess strapping of the strap parts 131 to go to a hand-carry configuration.

Figure 4:
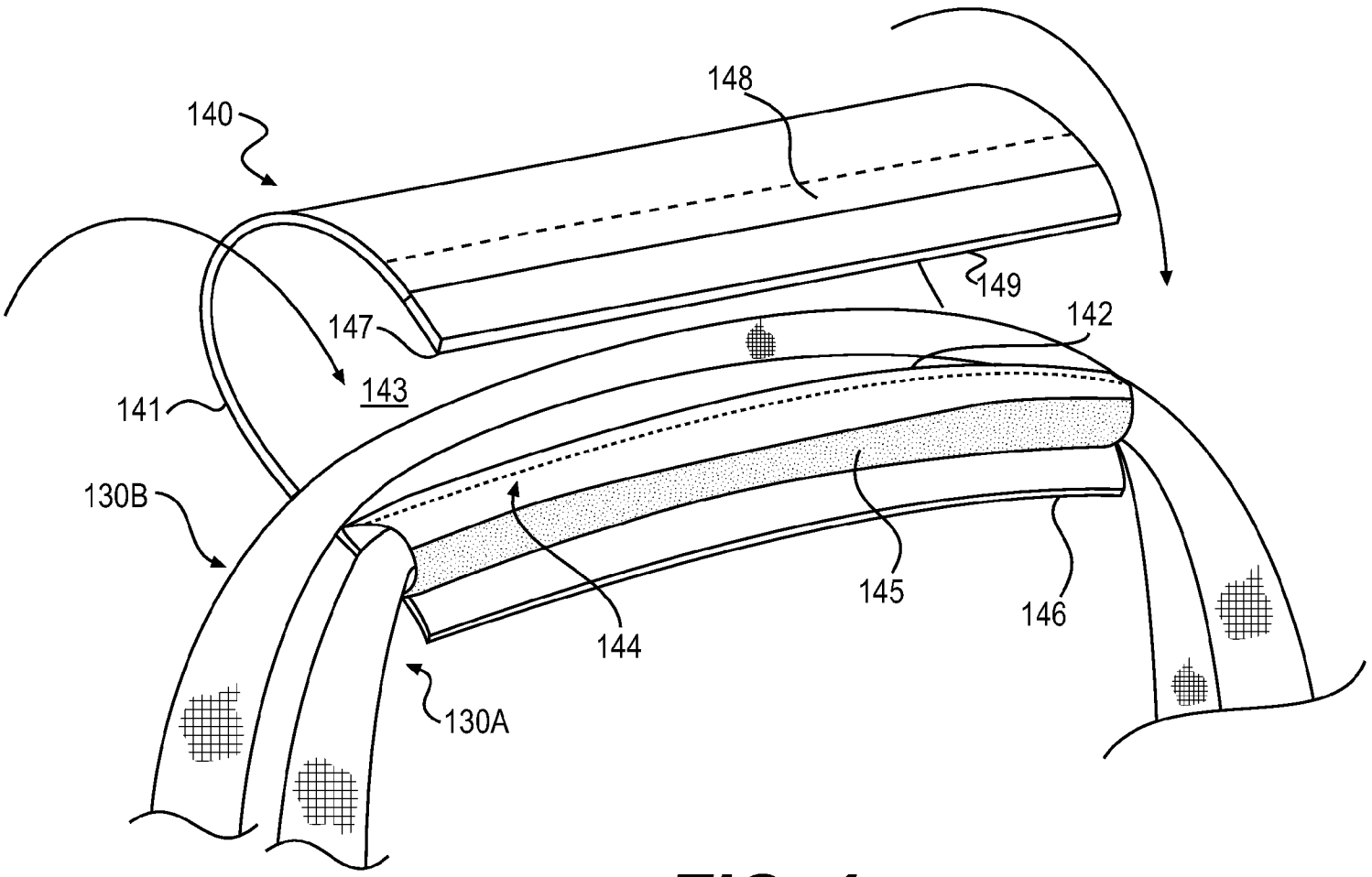
FIG. 4 is partial enlarged view of the handle to strap interface to illustrate constituent components thereof.

FIG. 4 is partial enlarged view of the handle to strap interface to illustrate constituent components thereof. Referring to FIG. 4, the handle 140 includes flexible, foam padded, handle body 141. The body 141 has a first end 142 that fixedly encloses webbing loop 130A and to an inner surface 143 of the body 141. FIG. 3 illustrates a configuration when the two webbing loops are separated, the handle 140 remains wrapped around webbing loop 130A.

In FIG. 4, a section 144 of the handle body that encloses webbing loop 130A includes a fastener 145 thereon. In an example, this may be a strip of Velcro which extends cross-wise. Section 144 also has a pull tab 146 extending outward therefrom.

The free end or unattached portion of the handle body 141 is configured to loop around webbing loop 130B and again over webbing loop 130A. The body second end 147 includes a fastener thereon, such as a strip of Velcro which extends cross-wise along the inner surface 143 at the second end 147, as generally indicated by the dotted line in FIG. 4. Like section 144, second end 147 includes a pull tab 149.

The two fasteners 145, are configured to mate for securing the handle 140 around the webbing loops 130A, 130B. The two pull tabs 146, 149 are designed to align for quick release of the handle 140 from the webbing loops 130A/130B for adjustment thereof.

Accordingly, the handle 140 configuration may be desirable with the adjustability of the webbing loops/straps via the cam buckles 135. For example, the pull tabs 146, 149 permit ease of access for the user to pull open the adjustable (foam padded) shoulder strap. Since section 144 of the handle 140 fixedly loops around one of the webbing loops 130A and selectively around the other loop 130B, this handle 140 can slide down or up with the two connected loops 130A/B (regardless of how the user changes their desired carrying position). This allows the foam padded handle to stay connected to the webbing loops while simultaneously allowing position adjustments, making it more manageable for the user to have access for positioning goods within or out of the bag 100.

Figure 5:
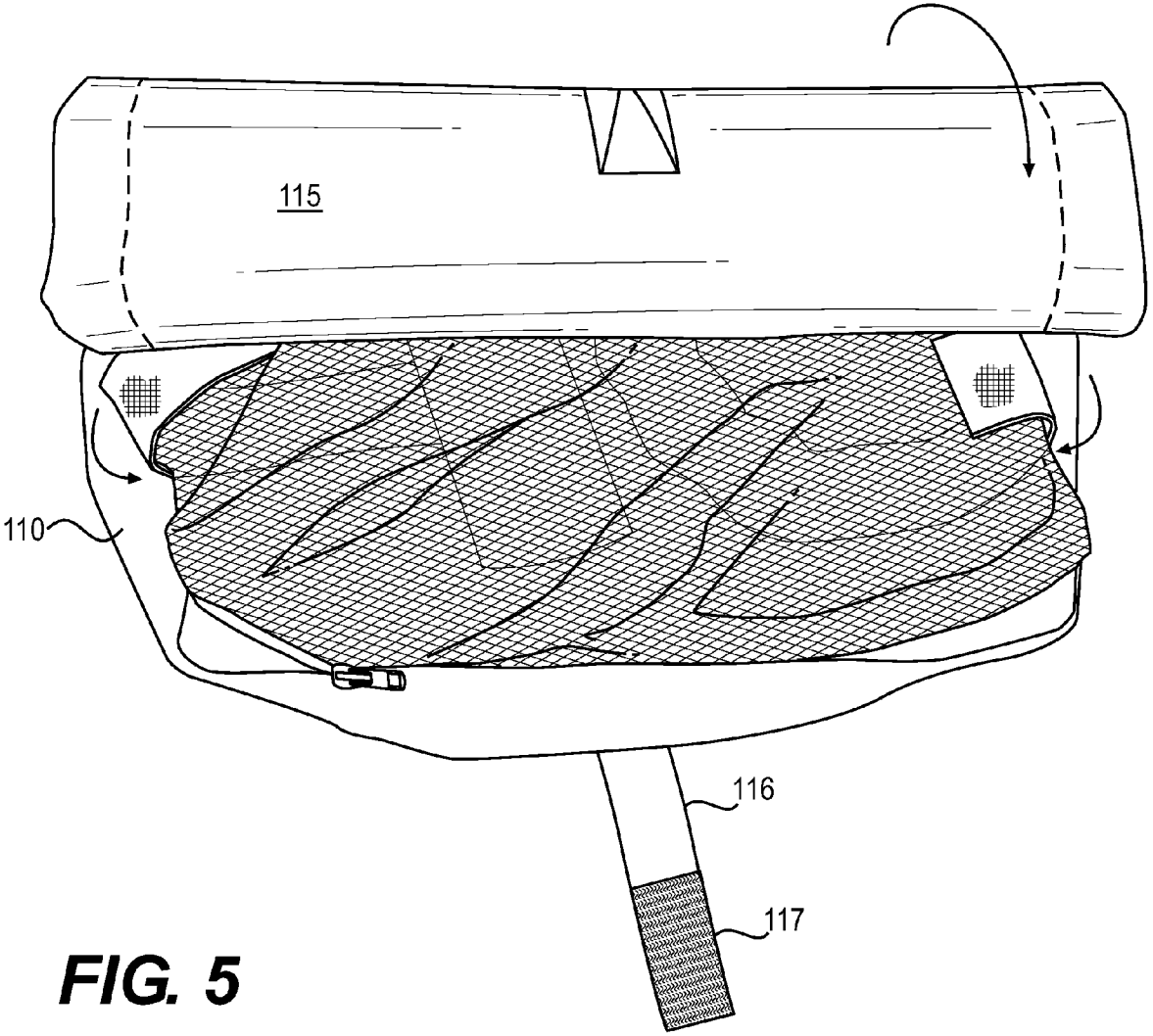
FIG. 5 is a front plan view of the bag in a partially rolled-up configuration.
Figure 6:
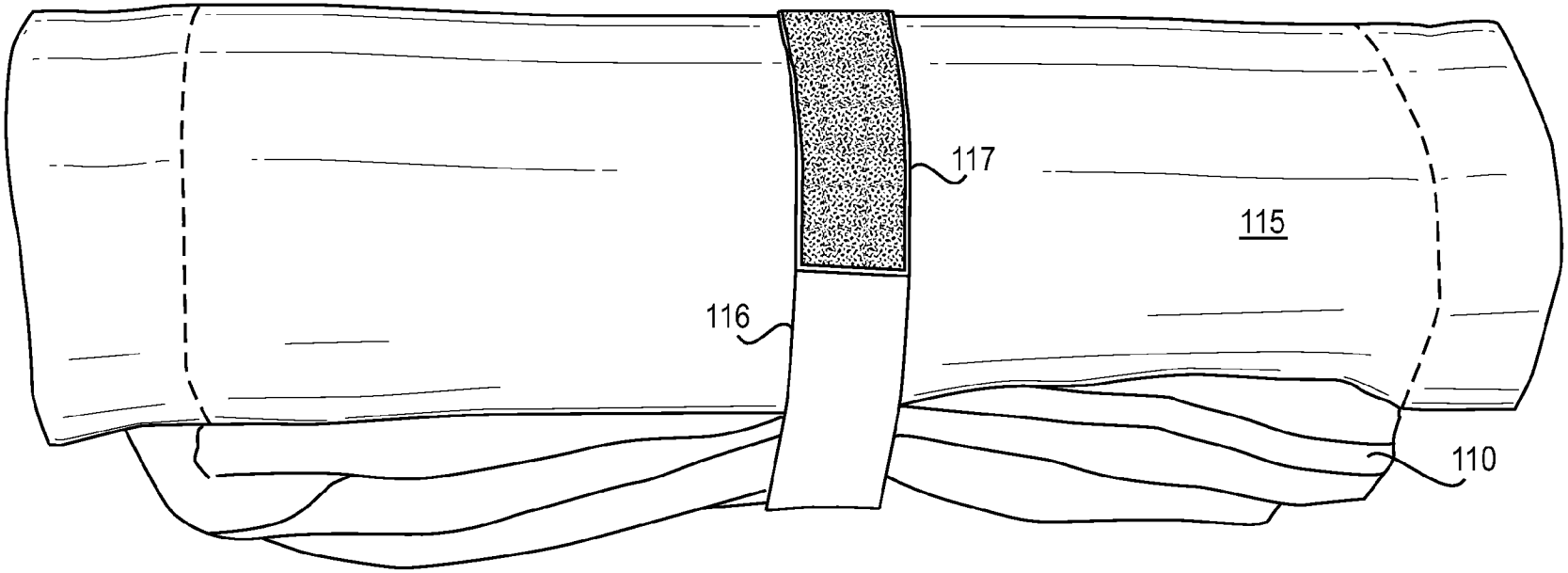
FIG. 6 is front plan view of the bag in a secured configuration for transport or storage.

FIG. 5 is a front plan view of the bag in a partially rolled-up configuration, and FIG. 6 is front plan view of the bag in a secured configuration for transport or storage. Referring to FIGS. 5 and 6, an underside surface 115 of the insulated compartment 110 includes fastening means such as a nylon strap 116 that is partially attached to the underside surface 115 but with a distal releasable Velcro end 117 that may be used as a cinch for the bag 100 in a storage or transport condition. In an example, bag 100 can be collapsed and rolled up and be cinched together tightly, the Velcro end 117 of the nylon strap 116 removed from a mating Velcro strip on the underside surface 115, then re-attached to its mating strip for ease of storage and transport.

Figure 7:
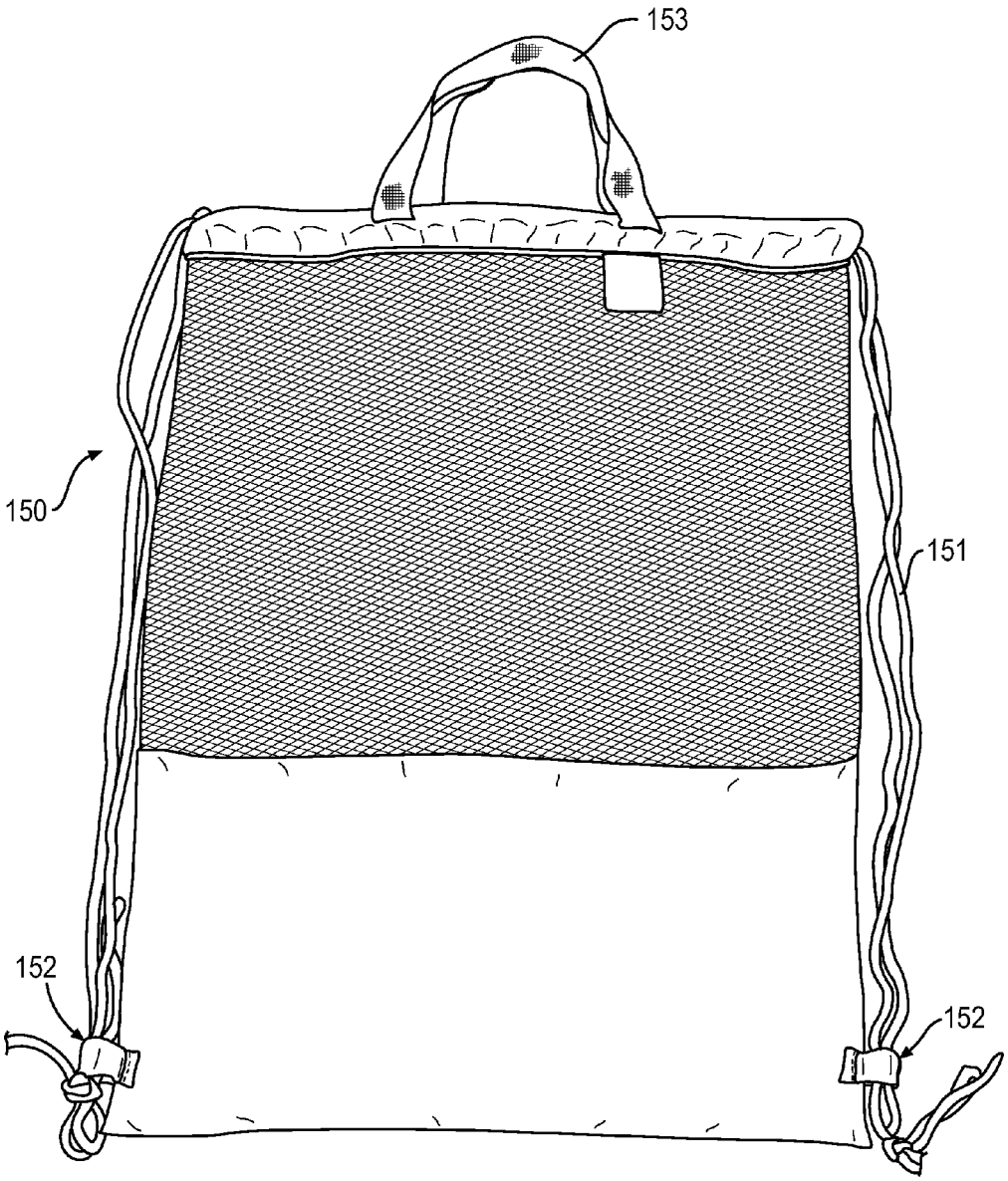
FIG. 7 is an example mesh bag for receiving the rolled-up self-supporting bag therein.
Figure 8:
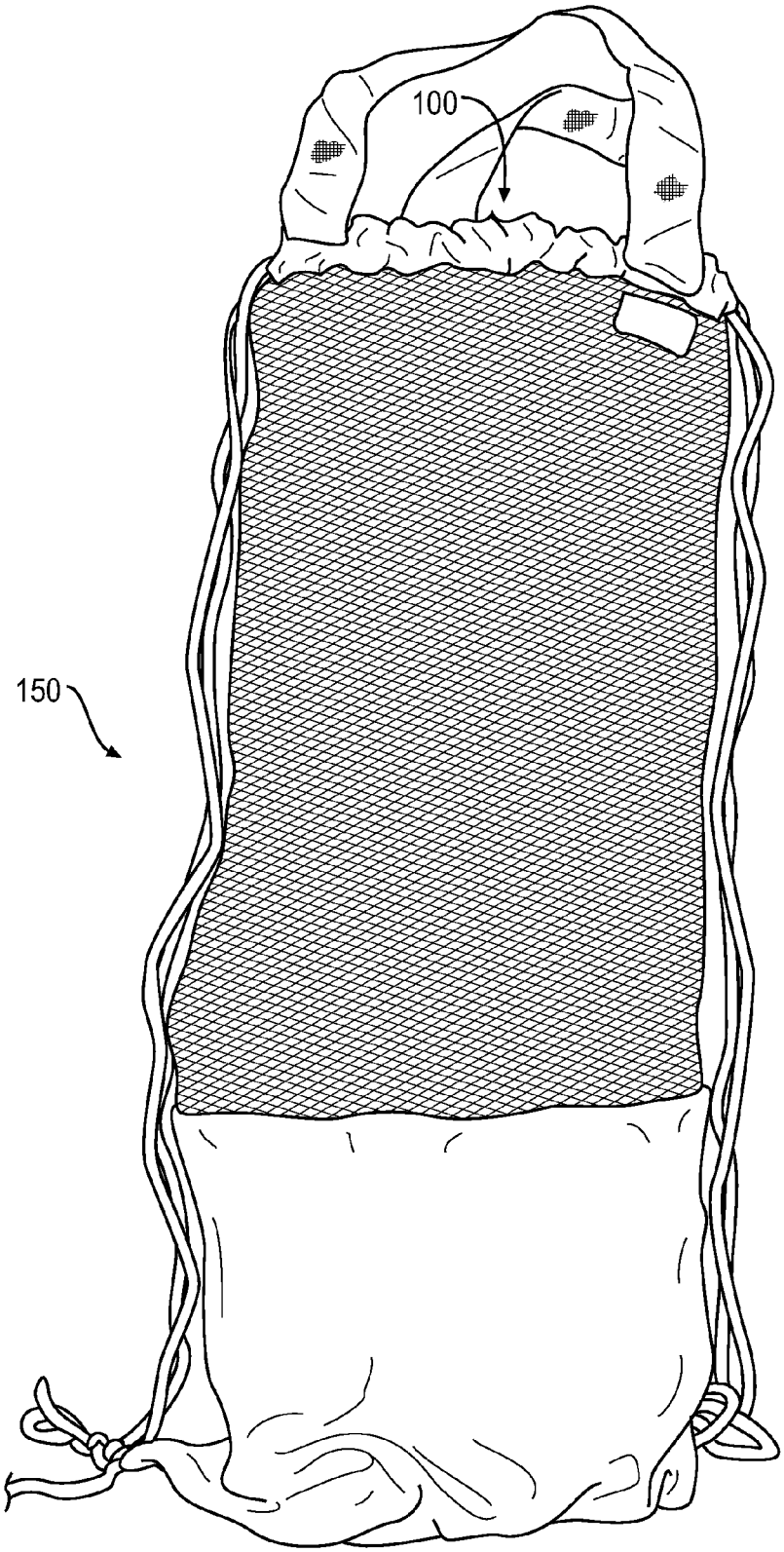
FIG. 8 is front plan view of the mesh bag enclosing the self-supporting bag in its secured configuration for storage or transport.

FIG. 7 is an example mesh bag for receiving the rolled-up self-supporting bag therein, and FIG. 8 is front plan view of the mesh bag enclosing the self-supporting bag in its secured configuration for storage or transport. Referring to FIGS. 7 and 8, the mesh bag 150 may be fabricated from at least 80% recyclable materials such as recycled water bottles (PET). Mesh bag 150 includes cinch straps 151, loops 152 and a carry handle 153. The rolled up self-supporting bag 100 (generally indicated by arrow) as shown in FIG. 6 is inserted long-end into the interior of mesh bag 150, the cinch straps 151 are thereafter pulled tightly through loops 152 and cinched upward to tighten the opening. FIG. 8 thus shows the assembly ready for storage or transport.

The example embodiment being thus described, it will be obvious that the same may be varied in many ways. Such variations are not to be regarded as departure from the example embodiment, and all such modifications as would be obvious to one skilled in the art are intended to be included herein.

What is claimed:

1. A self-supporting bag, comprising:

a first pair of upstanding mesh side panels joined together at respective side edges to form a shaped compartment body defining an inner body cavity having an opening at an upper a pair of opposed webbing loops defining carrying straps centrally located at opposed upper edges of each upstanding side panel forming the opening, a flexible foam padded handle completely enclosing one of the opposed webbing loops and selectively enclosing the other of the opposed webbing loops, the handle further including:

a handle body with a first end enclosing one opposed webbing loop and attached to an inner surface thereof, a section of the handle body enclosing the one opposed webbing loop including a first fastener thereon and a first pull tab extending outward therefrom, an unattached portion of the handle body configured to loop around the other opposed webbing loop and again over the one enclosed opposed webbing loop, the unattached portion terminating at a second end of the handle body, the second end including a second fastener thereon and a second pull tab extended outward therefrom, the first and second fasteners configured to mate for securing the handle around the opposed webbing loops, the first and second pull tabs aligning for quick release of the handle from the opposed webbing loops for adjustment thereof, compartment affixed to lower edges of the joined first pair of mesh side panels, the compartment configured as a thermal insulated hot and cold storage container and formed of a material including a pair of single or double polyethylene terephthalate aluminum (PET Al) bubble film layers sandwiched between two outer PET Al layers, a top outer surface of the insulated compartment forming a bottom panel for the inner body cavity of the shaped compartment body, the insulated compartment including a re-closeable opening accessible from the exterior of the bag, and a second plurality of mesh panels attached above the insulated compartment on outer surfaces of the first pair of upstanding mesh side panels as a plurality of end pockets and side pockets around the periphery of the bag, the end pockets providing rigidity to the bag, rendering the bag self supporting in the absence of rigid framing.

2. The bag of claim 1, further comprising:

closure means affixed to inner surfaces of each side panel upper edge, the closure means adapted to removably connect the side panels together.

3. The bag of claim 2, wherein the closure means includes a fixed-width closer centrally located on each side panel upper inner surface.

4. The bag of claim 1, further comprising:

a pair of cam buckles, each affixed on separate facing strap parts of the opposed loops where the strap part meets a respective side panel upper edge.

5. The bag of claim 4, wherein each cam buckle includes a flip latch configured to be opened to provide quick release of excess strap part of its corresponding webbing loop for adjustment between a hand-held and shoulder-wear configuration for the bag.

6. The bag of claim 1, wherein the re-closeable opening is embodied by flat locking sliders or zippers that encircle the entire insulated compartment and permit access thereto.

7. The bag of claim 1, wherein one of the side panels includes a centrally located re-closable side pocket for personal effects items.

8. A grocery shopping bag for carrying food, beverages, and other sundry items therein, comprising the self-supporting bag of claim 1.

9. A tote bag for carrying attire, equipment, food, beverages, and other sundry articles therein, comprising the self-supporting bag of claim 1.

10. A self-supporting bag, comprising:

a first pair of upstanding mesh side panels joined together at respective side edges to form a shaped compartment body defining an inner body cavity having an opening at an upper end thereof, compartment affixed to lower edges of the joined first pair of mesh side panels so as to form a bottom panel for the inner body cavity of the shaped compartment body, the compartment configured as a thermal insulated hot and cold storage container and formed of a material including a pair of single or double polyethylene terephthalate aluminum (PET Al) bubble film layers sandwiched between two outer PET Al layers, a plurality of mesh end pockets arranged on the periphery of the bag, the mesh end pockets providing rigidity to the bag to render the bag self-supporting in the absence of rigid framing, a pair of opposed webbing loops defining carrying straps centrally located at opposed upper edges of each upstanding side panel at the opening of the bag, a handle enclosing one of the opposed webbing loops and selectively enclosing the other of the opposed webbing loops, the handle further including: a handle body with a first end enclosing one opposed webbing loop and attached to an inner surface thereof, a section of the handle body enclosing the one opposed webbing loop including a first fastener thereon and a first pull tab extending outward therefrom, an unattached portion of the handle body configured to loop around the other opposed webbing loop and again over the one enclosed opposed webbing loop, the unattached portion terminating at a second end of the handle body, the second end including a second fastener thereon and a second pull tab extended outward therefrom, the first and second fasteners configured to mate for securing the handle around the opposed webbing loops, the first and second pull tabs aligning for quick release of the handle from the opposed webbing loops for adjustment thereof, and a pair of cam buckles, each affixed on separate facing strap parts of the opposed loops where the strap part meets a respective side panel upper edge.

11. The bag of claim 10, wherein each cam buckle includes a flip latch configured to be opened to provide quick release of excess strap part of its corresponding webbing loop for adjustment between a hand-held and shoulder-wear configuration for the bag.

* * * * *